US008624800B2

(12) United States Patent
Yang et al.

(10) Patent No.: US 8,624,800 B2
(45) Date of Patent: Jan. 7, 2014

(54) LIQUID CRYSTAL DISPLAY DEVICE AND DRIVING METHOD THEREOF

(75) Inventors: Jin-Wook Yang, Yongin (KR); Jun-Woo Hong, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 298 days.

(21) Appl. No.: 13/028,732

(22) Filed: Feb. 16, 2011

(65) Prior Publication Data

US 2012/0113089 A1 May 10, 2012

(30) Foreign Application Priority Data

Nov. 10, 2010 (KR) ..... 10-2010-0111465

(51) Int. Cl.
*G09G 3/18* (2006.01)

(52) U.S. Cl.
USPC ..... 345/52; 345/50; 345/54; 345/87; 345/215; 349/37; 349/41

(58) Field of Classification Search
USPC ..... 345/38, 50–54, 64, 87–104; 349/37–41
See application file for complete search history.

(56) References Cited

U.S. PATENT DOCUMENTS 5,646,643 A * 7/1997 Hirai et al. ..... 345/100
6,377,252 B2 * 4/2002 Ikeda ..... 345/211
7,289,116 B2 * 10/2007 Tanaka ..... 345/211
8,085,263 B2 * 12/2011 Uehara ..... 345/213
2005/0052447 A1 * 3/2005 Ishiyama ..... 345/211
2006/0238479 A1 * 10/2006 Tsuchiyama et al. ..... 345/98
2007/0120802 A1 * 5/2007 Lee et al. ..... 345/98
2008/0084410 A1 * 4/2008 Uehara ..... 345/211
2010/0245305 A1 * 9/2010 Yokoyama et al. ..... 345/205
2013/0010015 A1 * 1/2013 Yamauchi ..... 345/690

FOREIGN PATENT DOCUMENTS

KR 10-2008-0009447 1/2008
KR 10-2008-0054549 6/2008
KR 10-2008-0060793 7/2008
KR 10-2010-0000076 1/2010

* cited by examiner

*Primary Examiner* — Amare Mengistu
*Assistant Examiner* — Vinh Lam
(74) *Attorney, Agent, or Firm* — Robert E. Bushnell, Esq.

(57) ABSTRACT

A liquid crystal display (LCD) includes: a liquid crystal panel including a plurality of pixels; a data driver applying a data voltage to a plurality of data lines connected to the plurality of pixels; a scan driver applying a scan voltage to a plurality of scan lines connected to the plurality of pixels in synchronization with a scan clock signal controlling an output of the scan signal for the data voltage to be applied to the plurality of pixels; and a boost driver applying a primary boost voltage and a secondary boost voltage to a plurality of boost lines connected to the plurality of pixels in synchronization with a boost clock signal controlling the output of the boost voltage, wherein the boost clock signal has different synchronization from the scan clock signal controlling the output of the scan signal.

17 Claims, 8 Drawing Sheets

LIQUID CRYSTAL DISPLAY DEVICE AND DRIVING METHOD THEREOF

CLAIM OF PRIORITY

This application makes reference to, incorporates the same herein, and claims all benefits accruing under 35 U.S.C. §119 from an application earlier filed in the Korean Intellectual Property Office on 10 Nov. 2010, and there duly assigned Serial No. 10-2010-0111465 by that Office.

BACKGROUND OF THE INVENTION

1. Field of the Invention

The present invention relates to a liquid crystal display (LCD) and a driving method thereof. More particularly, the present invention relates to a liquid crystal display (LCD) using an ALS driving method, and a driving method thereof.

2. Description of the Related Art

As a representative display device, a liquid crystal display (LCD) includes two display is panels provided with pixel electrodes and a common electrode, and a liquid crystal layer having dielectric anisotropy interposed between the two panels. The pixel electrodes are arranged in a matrix format and are connected to a switch such as a thin film transistor (TFT) to sequentially receive a data voltage by row. The common electrode is formed over the entire surface of the display panel to receive a common voltage. The pixel electrodes, the common electrode, and the liquid crystal layer interposed between the pixel electrodes and the common electrode form a liquid crystal capacitor from a circuital view, and the liquid crystal capacitor and a switch connected thereto become a basic unit forming a pixel.

In the liquid crystal display (LCD), an electric field is generated in the liquid crystal layer by applying voltages to the two electrodes, and transmittance of light passing through the liquid crystal layer is controlled by controlling the electric field to thereby display a desired image. At this time, in order to prevent a degradation phenomenon caused by long application of an electric field in one direction to a liquid crystal layer, polarity of the data voltage with respect to the common voltage is inverted for respective frames, respective rows, or respective pixels.

The ALS driving method as a driving method for boosting a voltage of a pixel boosts the voltage of a pixel electrode that is floated after a gate voltage is turned off by coupling it with the voltage of an ALS line. The boosting of the voltage of the pixel electrode may be induced by increasing or decreasing the voltage of the boost line during one frame. The ALS driving method may reduce a source output voltage of a driving circuit, thereby reducing power consumption. Also, the ALS driving method may increase the pixel voltage, and the response speed of the liquid crystal may be improved through the application of the high pixel voltage.

However, the boost line accords with the direction of a scan line and overlaps the data line, such that the voltage of the boost line may have noise because of coupling with the data voltage applied to the data line.

For example, when the scan line is applied with a gate-on voltage such that the data line is applied with the data voltage, the noise voltage is generated in the boost line by the coupling with the data line. The noise voltage generated in the boost line must be restored until the gate-off voltage is applied and the boost voltage is applied. If the noise voltage generated in the boost line is not restored until the boost voltage is applied, the output signal of the boost line is changed and output by the noise voltage.

When the gate-off voltage is applied, the deviation of the noise voltage that is not restored in the boost line causes a difference of the pixel voltage, and thereby crosstalk may be generated.

The above information disclosed in this Background section is only for enhancement of understanding of the background of the invention and therefore it may contain information that does not form the prior art that is already known in this country to a person of ordinary skill in the art.

SUMMARY OF THE INVENTION

A technical object of the present invention provides a liquid crystal display (LCD) reducing crosstalk due to a noise generated in a boost line by coupling along with a data line in an ALS driving method, and a driving method thereof.

A liquid crystal display (LCD) according to an exemplary embodiment of the present invention includes: a liquid crystal panel including a plurality of pixels; a data driver applying a data voltage to a plurality of data lines connected to a plurality of pixels; a scan driver applying a scan voltage to a plurality of scan lines connected to a plurality of pixels in synchronization with a clock signal controlling an output of the scan signal for the data voltage to be applied to the plurality of pixels; and a boost driver applying a primary boost voltage and a secondary boost voltage to a plurality of boost lines connected to a plurality of pixels in synchronization with a boost clock signal controlling the output of the boost voltage, wherein the boost clock signal has different synchronization from the scan clock signal controlling the output of the scan signal.

The boost driver may apply the primary boost voltage at a predetermined time that is delayed from a time that the scan signal of the gate-off voltage is applied.

The boost driver may apply the secondary boost voltage at a time that is delayed by the clock signal controlling the output of the boost voltage after the primary boost voltage is applied.

The primary boost voltage may have a middle value between the initial boost voltage and the secondary boost voltage. The primary boost voltage may be a common voltage.

The data driver may invert the polarity of the data voltage for a line of the plurality of scan lines and apply the data voltage.

The initial boost voltage may be a voltage of a logic low level, and the secondary boost is voltage may be a voltage of a logic high level. The initial boost voltage may be a voltage of a logic high level, and the secondary boost voltage may be a voltage of a logic low level.

The time that the primary boost voltage and secondary boost voltage are applied may be adjusted to compensate the voltage of the plurality of pixels that is lower than the target voltage of the pixel by the coupling between the plurality of data lines and the plurality of boost lines.

A driving method of a liquid crystal display (LCD) according to another exemplary embodiment of the present invention includes: applying a scan signal of a gate-on voltage to a scan line connected to a pixel; applying a data voltage to a data line connected to the pixel during a time that the scan signal of the gate-on voltage is applied; applying a primary boost voltage to a boost line connected to the pixel at a time that a predetermined time is delayed from a time that the application of the data voltage to the pixel is finished; and applying a secondary boost voltage to the boost line at a time that a predetermined time is delayed from a time that the primary boost voltage is applied.

The primary boost voltage and the secondary boost voltage may be applied to the boost line in synchronization with the clock signal controlling the output of the boost voltage having the different synchronization from the clock signal controlling the output of the scan signal.

The primary boost voltage may be a middle value between the initial boost voltage and the secondary boost voltage. The primary boost voltage may be a common voltage.

The polarity of the data voltage may be inverted for a line of a plurality of scan lines.

The initial boost voltage may be a voltage of a logic low level, and the secondary boost voltage may be a voltage of a logic high level. The initial boost voltage may be a voltage of a logic high level, and the secondary boost voltage may be a voltage of a logic low level.

The time that the primary boost voltage and secondary boost voltage are applied may be adjusted to compensate the voltage of the pixel that is lower than the target voltage of the pixel by the coupling between the data lines and the boost lines.

The crosstalk caused by the noise generated in the boost lines due to the coupling with the data lines may be reduced, and an ALS driving method may be applied to a liquid crystal display (LCD) of high resolution.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
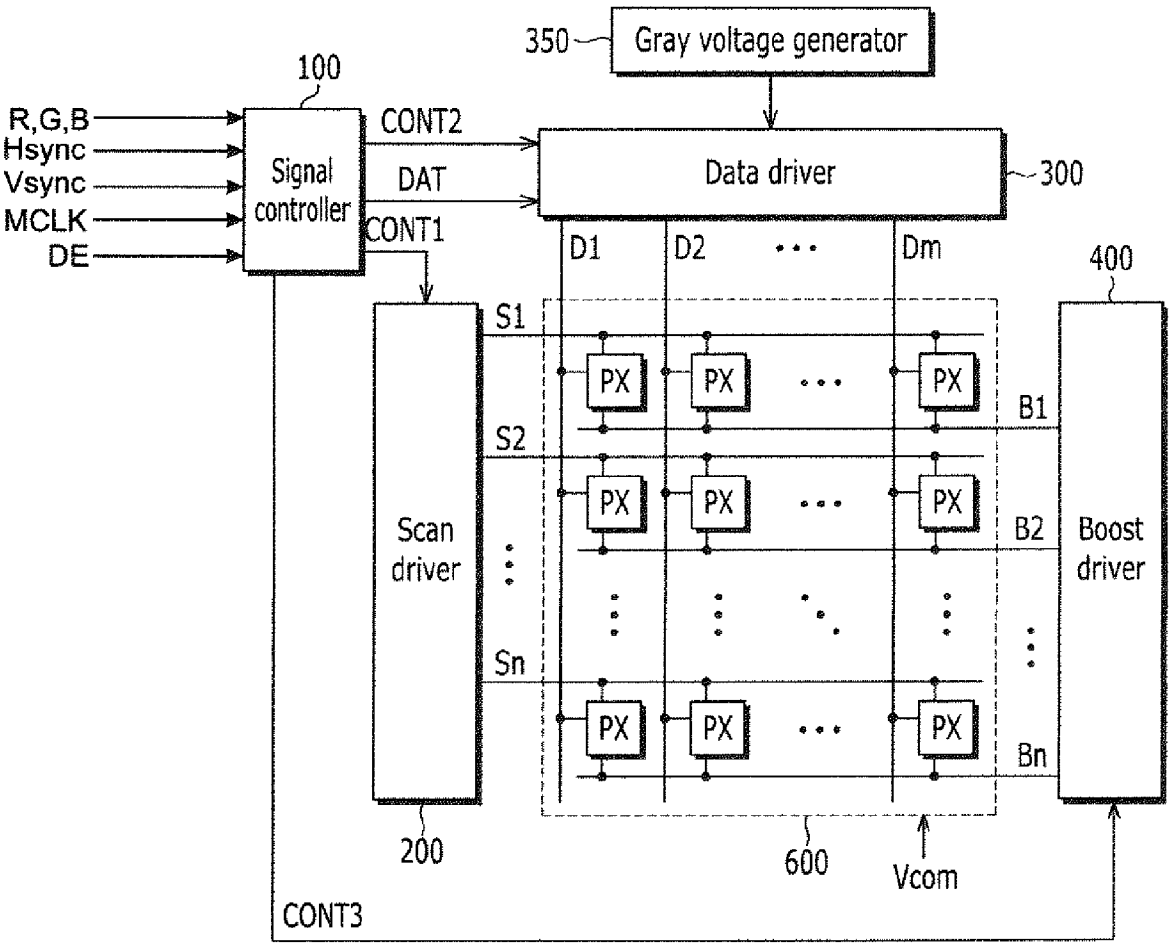
FIG. 1 is a block diagram of a liquid crystal display (LCD) according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Furthermore, with exemplary embodiments of the present invention, a detailed description is given as to the constituent elements in the first exemplary embodiment with reference to the relevant drawings by using the same reference numerals for the same constituent elements, while only constituent elements that are different from those related to the first exemplary embodiment are described in other exemplary embodiments.

Parts that are irrelevant to the description are omitted in order to clearly describe the present invention, and like reference numerals designate like elements throughout the specification.

Throughout this specification and the claims that follow, when it is described that an element is "coupled" to another element, the element may be "directly coupled" to the other element is or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a liquid crystal display (LCD) according to an exemplary embodiment of the present invention.

Referring to FIG. 1, a liquid crystal display (LCD) includes a liquid crystal panel assembly 600, a scan driver 200 connected thereto, a data driver 300, a gray voltage generator 350 connected to a data driver 300, a boost driver 400, and a signal controller 100 controlling the drivers.

The liquid crystal panel assembly 600 includes a plurality of scan lines S1-Sn, a plurality of data lines D1-Dm, a plurality of boost lines B1-Bn, and a plurality of pixels PX. The plurality of pixels PX are connected to the plurality of signal lines S1-Sn, D1-Dm, and B1-Bn and arranged in an approximate matrix. The scan lines S1-Sn extend in an approximate row direction and are almost parallel to each other. The data lines D1 to Dm extend in a column direction and are almost parallel to each other. The boost lines B1-Bn respectively corresponding to the scan lines S1-Sn extend in the row direction. At least one polarizer (not shown) polarizing light is attached on an outer surface of the liquid crystal panel assembly 600.

The signal controller 100 receives video signals R, G, and B input from an external device and input control signals for controlling display of the input video signals. The video signals R, G, and B include luminance information of each pixel PX, and the luminance has a predetermined number of grays, for example 1024=210, 256=28, or 64=26. The input control signals exemplarily is include a vertical synchronization signal Vsync, a horizontal synchronization signal Hsync, a main clock signal MCLK, and a data enable signal DE.

The signal controller 100 processes the input video signals R, G, and B for operation conditions of the liquid crystal display panel assembly 600 and the data driver 300 based on the input video signals R, G, and B and the input control signals, and generates a scan control signal CONT1, a data control signal CONT2, and a boost control signal CONT3. The scan control signal CONT1 is provided to the scan driver 200. The data control signal CONT2 and a processed image data signal DAT are provided to the data driver 300. The boost control signal CONT3 is provided to the boost driver 400.

The signal controller 100 transmits the image data signal DAT and the data control signal CONT2 to the data driver 300. The data control signal CONT2 as a signal controlling the operation of the data driver 300 includes a horizontal synchronization start signal that notifies the transmission start of the image data signal DAT of one pixel row, a load signal, and a data clock signal. The load signal and the data clock signal are provided for instruction of outputs of the data signal to the data lines D1-Dm. The data control signal CONT2 may further include a reversal signal that inverts the polarity of a voltage of the data signal with respect to a common voltage Vcom.

The signal controller 100 transmits the scan control signal CONT1 to the scan driver 200. The scan control signal CONT1 includes a scan start signal in the scan driver, and at least one clock signal controlling an output of a gate-on voltage. The scan control signal CONT1 may further include an output enable signal that limits the duration of the gate-on voltage.

The signal controller 100 transmits the boost control signal CONT3 to the boost driver 400. The boost control signal CONT3 controls the output of a boost voltage Vboost (e.g., see FIG. 4) that is applied from the boost driver 400 to the pixels PX. The boost control signal CONT3 includes at least one clock signal controlling the output of the boost voltage Vboost.

The scan driver 200 is connected to the plurality of scan lines S1 to Sn of the liquid crystal panel assembly 600 to apply a scan signal to the plurality of scan lines S1 to Sn. The scan signal is formed of a combination of the gate-on voltage that turns on a switching transistor M1 (referring to FIG. 2) and a gate-off voltage that turns off the switching transistor M1 according to the scan control signal CONT1. The scan driver 200 applies the scan signal in synchronization with at least one clock signal controlling the output of the scan signal.

The data driver 300 is connected to the plurality of data lines D1-Dm of the liquid crystal panel assembly 600 and applies a data voltage Vdat (see FIG. 5) to the plurality of data lines D1-Dm. The data driver 300 selects a gray voltage from the gray voltage generator 350 and applies the selected gray voltage as the data signal to the plurality of data lines D1-Dm. The gray voltage generator 350 may provide a predetermined number of reference gray voltages rather than providing voltages for all the grays, and in this case, the data driver 300 may generate gray voltages for all grays by dividing the reference gray voltages and selecting a data voltage Vdat corresponding to the data signal.

The boost driver 400 transmits the boost voltage Vboost to the plurality of boost lines B1-Bn of the liquid crystal panel assembly 600 according to the boost control signal CONT3. The boost voltage Vboost respectively applied to the plurality of boost lines B1-Bn is not synchronized with a scan signal Scan (see FIG. 4) applied to the corresponding scan lines S1-Sn, but is delayed by is a predetermined time for the level to be changed. That is, a clock signal controlling the output of the boost voltage may have different synchronization from a clock signal controlling the output of the scan signal. Here, the clock signal controlling the output of the boost voltage is referred to as a boost clock signal, and the clock signal controlling the output of the scan signal is referred to as a scan clock signal.

Each of the above-mentioned driving apparatus may be directly mounted on the liquid crystal display panel assembly 600 in the form of at least one IC chip, may be mounted on a flexible printed circuit film (not shown) and then mounted on the liquid crystal panel assembly 600 in the form of a tape carrier package (TCP), or may be mounted on a separate printed circuit board (not shown). Alternatively, the drivers may be integrated with the liquid crystal display panel assembly 600 together with, for example, the signal lines G1-Gn, D1-Dm, and B1-Bn.

Figure 2:
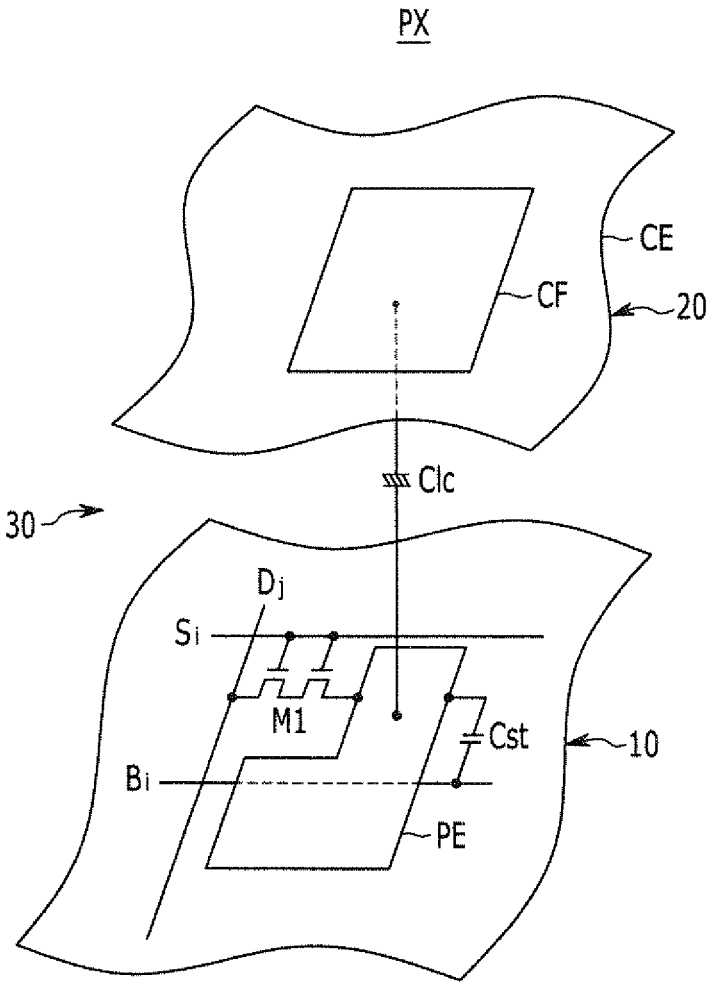
FIG. 2 is an equivalent circuit diagram of one pixel of FIG. 1.

FIG. 2 is an equivalent circuit diagram of one pixel PX of FIG. 1.

Referring to FIG. 2, the liquid crystal panel assembly 600 includes a thin film transistor array panel 10 and a common electrode panel 20 facing each other, a liquid crystal layer 30 interposed therebetween, and a spacer (not shown) forming a gap between the two panels 10 and 20 and compressed to some degree.

Referring to one pixel PX of the liquid crystal panel assembly 600, the pixel PX connected to the i-th (i=1–n) scan line Si, the boost line Bi, and the j-th (j=1–m) data line Dj includes a switching transistor M1, a liquid crystal capacitor Clc and a storage capacitor Cst connected thereto.

The switching transistor M1 as a three terminal element such as a thin film transistor provided in the thin film transistor array panel 10 includes a gate electrode connected to the scan line is S1, an input terminal connected to the data line D1, and an output terminal connected to a pixel electrode PE of the liquid crystal capacitor Clc. Here, the thin film transistor may include amorphous silicon or polycrystalline silicon.

The switching transistor M1 may be an n-channel field effect transistor. Here, the gate-on voltage turning on the switching transistor M1 is a voltage of a logic high level, and the gate-off voltage turning off the switching transistor M1 is a voltage of a logic low level. Or, the switching transistor M1 may be a p-channel field effect transistor. Here, the gate-on voltage turning on the switching transistor M1 is a voltage of a logic low level, and the gate-off voltage turning off the switching transistor M1 is a voltage of a logic high level.

Hereafter, it is assumed that the switching transistor M1 is the n-channel field effect transistor.

The liquid crystal capacitor Clc includes the pixel electrode PE of the thin film transistor array panel 10 and a common electrode CE of the common electrode panel 20 facing thereto. That is, the liquid crystal capacitor Clc has the pixel electrode PE of the thin film transistor array panel 10 and the common electrode CE of the common electrode display panel 20 as two terminals, and the liquid crystal layer 30 between the pixel electrode PE and the common electrode CE functions as a dielectric material.

The pixel electrode PE is connected to the switching transistor M1, and the common electrode CE is formed on the whole surface of the common electrode panel 20 and receives a common voltage Vcom. On the other hand, the common electrode CE may be provided on the thin film transistor array panel 10. In this case, at least one of the two electrodes PE and CE may be is made in the form of a line or a bar. The common voltage Vcom may be a constant voltage of a predetermined level, and may be a voltage of about 0V.

A color filter CF may be formed on a portion of the region of the common electrode CE of the common electrode panel 20. In order to realize color display, each pixel PX uniquely displays one of primary colors (spatial division), or each pixel PX temporally and alternately displays primary colors (temporal division). Then, the primary colors are spatially or temporally synthesized, and thus a desired color is recognized. An example of the primary colors may be three primary colors of red, green, and blue.

As an example of the spatial division, each pixel PX has a color filter CF that represents one of the primary colors in a region of the common electrode panel 20. Unlike this, the color filter CF may be formed above or below the subpixel electrode PE of the thin film transistor array panel 10.

The storage capacitor Cst includes one terminal connected to the pixel electrode PE and the other terminal connected to the boost line Bi. The boost line Bi may be provided in the thin film transistor array panel 10, and the boost line Bi and the pixel electrode PE may overlap each other via an insulator interposed therebetween. The boost line Bi may be applied with a predetermined to voltage such as the common voltage Vcom.

Figure 3:
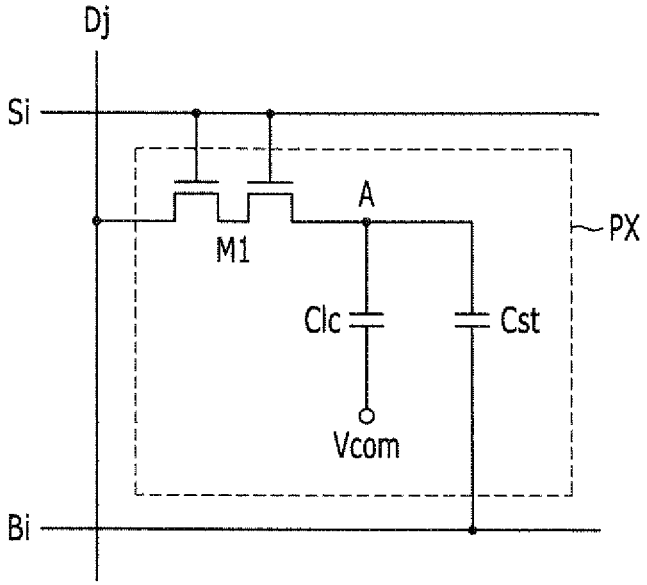
FIG. 3 is a circuit diagram to explain an operation of a liquid crystal display (LCD) of FIG. 1.

FIG. 3 is a circuit diagram to explain an operation of the liquid crystal display (LCD) of FIG. 1.

Referring to FIG. 3, the pixel PX is connected to the i-th scan line Si, the i-th boost line Bi and the j-th data line Dj.

If the scan line Si is applied with the gate-on voltage, the switching transistor M1 is turned on. During the time that the scan line Si is applied with the gate-on voltage, the data voltage Vdat is applied to the data line Dj and is transmitted to a node A. The storage (or sustain) capacitor Cst is charged according to a difference between the voltage of the node A and the common voltage Vcom to generate an electric field to the liquid crystal layer of the liquid crystal capacitor Clc. The storage capacitor Cst constantly maintains the electric field generated to the liquid crystal layer of the liquid crystal capacitor Clc.

If the scan line Si is applied with the gate-off voltage, the switching transistor M1 is turned off and the node A becomes a floating state. Here, if the boost line Bi is applied with the boost voltage Vboost of a predetermined level, the voltage of the liquid crystal capacitor Clc is boosted corresponding to the boost voltage Vboost by the coupling. For example, if the boost voltage Vboost is increased to a positive voltage with respect to the common voltage Vcom, the voltage of the liquid crystal capacitor Clc is also increased. If the boost voltage Vboost is decreased to a negative voltage with respect to the common voltage Vcom, the voltage of the liquid crystal capacitor Clc is also decreased. The degree that the voltage of the liquid crystal capacitor Clc is boosted according to the level of the boost voltage Vboost is determined according to the capacitance ratio of the storage capacitor Cst and the liquid crystal capacitor Clc.

The boost voltage Vboost may be divided into a primary boost voltage and a secondary boost voltage. The primary boost voltage may be applied at a time that a predetermined time is delayed from the time that the scan line Si is applied with the gate-off voltage and that the application of the data voltage Vdat to the pixel is finished, and the secondary boost voltage may be is applied at a time that is a predetermined delayed time after the primary boost voltage is applied.

The electric field is generated to the liquid crystal layer 30 of the liquid crystal capacitor Clc according to the difference between the voltage of the node A that is boosted by the boost voltage Vboost and the common voltage Vcom such that the transmittance of the light passing through the liquid crystal layer 30 of the liquid crystal capacitor Clc is changed, thereby displaying the images. The storage capacitor Cst constantly maintains the electric field generated to the liquid crystal layer 30 of the liquid crystal capacitor Clc. As described above, each pixel PX is input with the data signal.

By repeating such a process using one horizontal period (may be called "1H", and is the same as a period of a horizontal synchronization signal Hsync and a data enable signal DE) in units, the gate-on voltage is sequentially applied to all the scan lines S1-Sn and the data signal is applied to all the pixels PX such that an image of a frame is displayed.

When one frame is finished and the next frame is started, the data driver 300 generates the data voltage according to an inversion signal for the polarity of the data voltage applied to each pixel PX to be opposite to the polarity of the previous frame. This is referred to as frame inversion. At this time, the polarity of the image data signal flowing on one data line may be periodically changed even within one frame according to a characteristic of the inversion signal (for example, row inversion and dot inversion), or the polarity of the image data signal applied to one pixel row may be changed (for example, column inversion and dot inversion).

The liquid crystal display (LCD) of the present invention is operated by a line inversion method in which the common voltage Vcom is constantly maintained during one frame and the polarity of the data voltage is inverted per line (row inversion). The polarity of the common voltage Vcom may be changed per frame.

Figure 4:
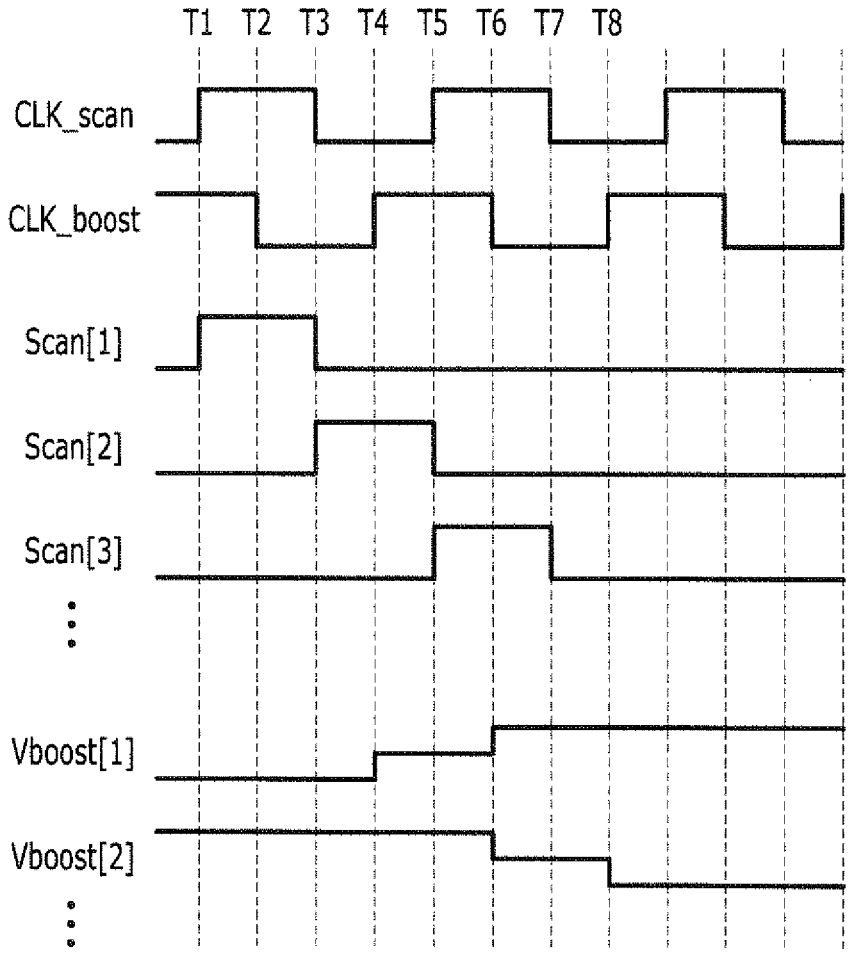
FIG. 4 is a timing diagram to explain an operation of a liquid crystal display (LCD) of FIG. 1.

FIG. 4 is a timing diagram to explain an operation of the liquid crystal display (LCD) shown in FIG. 1.

Referring to FIGS. 1 to 4, the scan clock signal CLK_scan has a voltage of the logic high level and a voltage of the logic low level alternately applied with a pulse width of 2 T. For example, the voltage of the logic high level and the voltage of the logic low level may be alternately applied by a method in which the scan clock signal CLK_scan is applied with the voltage of the logic high level in a period T1-T3 and the voltage of the logic low level in a period T3-T5.

Here, 2 T may be equal to one horizontal cycle 1 H.

The boost clock signal CLK_boost has a delay of 1 T, that is, the synchronization difference of ½ a horizontal cycle ½H with the scan clock signal CLK_scan and may be applied with the pulse of 2 T. For example, the voltage of the logic high level and the voltage of the logic low level may be alternately applied with the method in which the boost clock signal is applied with the voltage of the logic low level in the period T2-T4 and the voltage of the logic high level in the period T4-T6. Here, for better understanding and ease of description, it is assumed that the cycle of the boost clock signal CLK_boost has the synchronization difference for the scan clock signal CLK_scan of ½ a horizontal cycle, however the cycle of the boost clock signal CLK_boost may be appropriately adjusted for the difference of the pixel voltage by the coupling of the boost line for the data line to be compensated. This will be described later.

In the period T1-T3, the scan driver 200 applies the scan signal Scan[1] of the gate-on voltage to the first scan line S1 in synchronization with the scan clock signal CLK_scan included in the scan control signal CONT1. The scan signal Scan[1] of the gate-on voltage turns-on the switching transistor M1 of the pixel PX connected to the first scan line. Here, an output enable signal included in the scan control signal CONT1 may be limited for the gate-on voltage to be maintained from the time T1 to the time T3, and thereby the gate-on voltage may be maintained from the time T1 to the time T3. A positive data voltage is applied to a plurality of data lines D1-Dm during the period T1-T3.

The boost driver 400 applies the boost voltage Vboost[1] to the first boost line corresponding to the first scan line. Here, the boost driver 400 is not synchronized to the time T3 at which the scan signal Scan is converted from the gate-on voltage to the gate-off voltage, but changes the level of the boost voltage[1] at the time T4. That is, the level of the boost voltage[1] is not synchronized to the scan clock signal CLK_scan or the scan signal Scan[1], but is delayed by a predetermined time and changed. Here, it is assumed that the level of the boost voltage[1] is delayed by 1 T (=½H) from the time that the scan line is applied with the gate-off voltage at T3.

The level of the boost voltage Vboost[1] of the first boost line corresponding to the first scan line applied with the scan signal Scan[1] is primarily increased at the time T4 and is secondarily increased at the time T6. The voltage of the pixel connected to the first scan line S1, that is, the voltage of the liquid crystal capacitor Clc, is boosted in proportion to the level of the boost voltage Vboost[1] that is changed at the time T4 and the time T6.

In the period T3-T5, the scan driver 200 applies the scan signal Scan[2] of the gate-on voltage to the second scan line S2. The scan signal Scan[2] of the gate-on voltage turns on the is switching transistor M1 of the pixel PX connected to the second scan line 51. A negative data voltage is applied to a plurality of data lines D1-Dm in the period T3-T5.

Here, the boost driver 400 is not synchronized to the time T5 that the scan signal Scan[2] is converted from the gate-on voltage to the gate-off voltage, but changes the level of the boost voltage Vboost[2] at the time T6. The level of the boost voltage Vboost[2] of the second boost line corresponding to the second scan line applied with the scan signal Scan[2] is primarily decreased at the time T6 and is secondarily decreased at the time T8. The voltage of the pixel connected to the second scan line S2 is boosted in proportion to the level of the boost voltage Vboost[2] that is changed at the time T6 and the time T8.

As described above, the boost driver 400 applies a primary boost voltage and a secondary boost voltage to the plurality of boost lines in synchronization with the clock signal CLK_boost controlling the output of the boost voltage having the different synchronization from the scan clock signal CLK_scan. The primary boost voltage is applied at the time that is delayed by a predetermined time (e.g., ½H) from the time that the pixel is applied with the data voltage and the scan line is applied with the gate-off voltage, and the secondary boost voltage is applied at the time that the predetermined time is delayed by the clock signal controlling the output of the boost voltage after the primary boost voltage is applied.

Therefore, in a line inversion method in which the positive data voltage and the negative data voltage are alternately applied to a plurality of data lines D1-Dm, the data voltage may be prevented from decreasing by the coupling between the data line and the boost line, or the boosting of the pixel voltage is decreased by the boost voltage.

Next, the data voltage and the boost voltage will be compared in a liquid crystal display (LCD) not according to the present invention and a liquid crystal display (LCD) according to the present invention.

Figure 5:
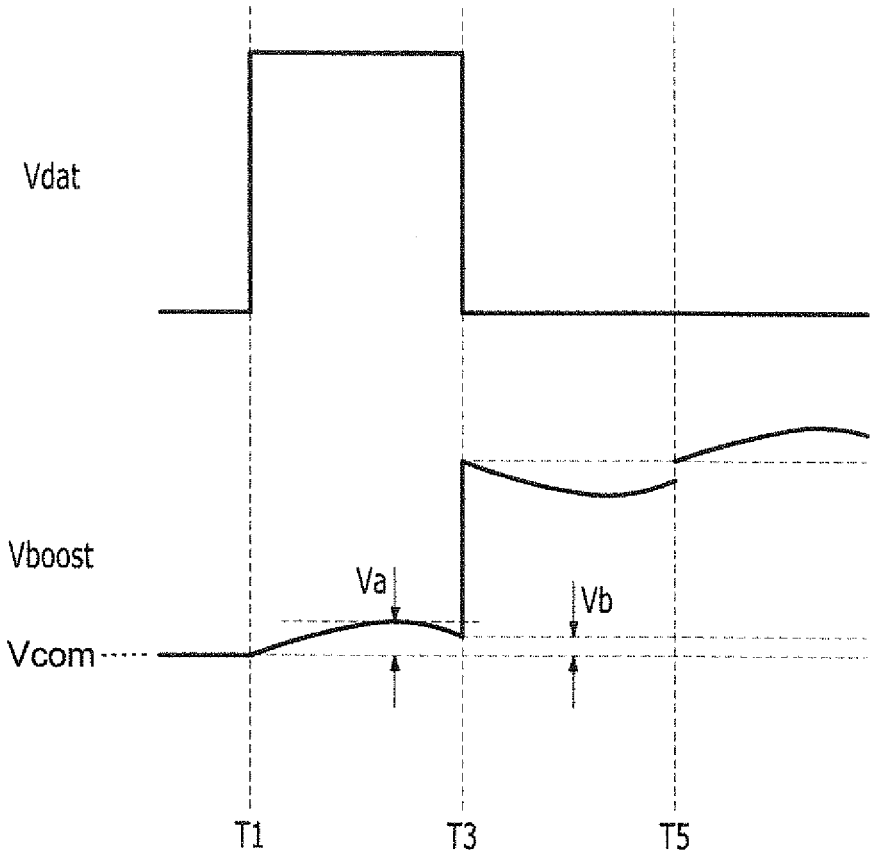
FIG. 5 is an example showing a data voltage and a boost voltage in a representative liquid is crystal display (LCD) different from the present invention.
Figure 6:
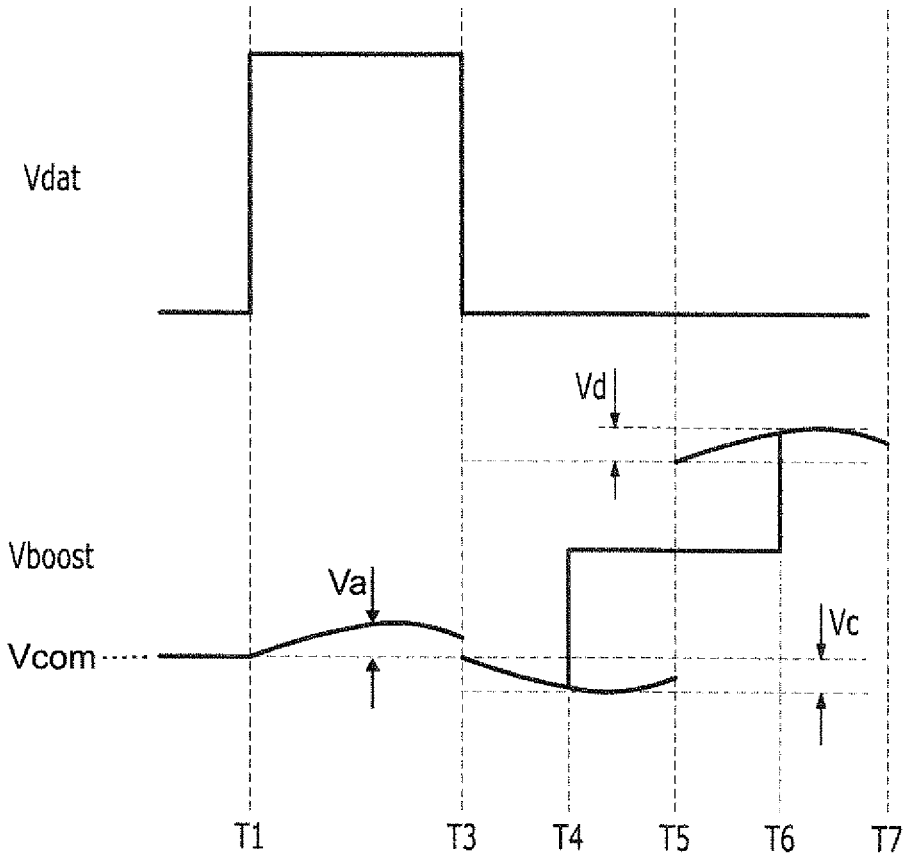
FIG. 6 is a view showing a data voltage and a boost voltage in a liquid crystal display (LCD) according to an exemplary embodiment of the present invention.

FIG. 5 is an example showing a data voltage and a boost voltage in a representative liquid crystal display (LCD) different from the present invention. FIG. 6 is a view showing a data voltage and a boost voltage in a liquid crystal display (LCD) according to an exemplary embodiment of the present invention.

Referring to FIG. 5 and FIG. 6, a positive predetermined data voltage Vdat with reference to the common voltage Vcom is applied to one of a plurality of data lines D1-Dm in the period T1-T3.

In FIG. 5, in the representative liquid crystal display (LCD) different from the present invention, the boost voltage Vboost of the logic high level is applied at the time T3 at which the application of the positive data voltage Vdat is finished. The voltage of the boost line is changed (increased) by the voltage Va due to the coupling between the data line and the boost line in the period T1-T3 at which the positive data voltage is applied, and the actual voltage of the pixel is decreased by the voltage Va. Also, the voltage of the boost line is not restored to the common voltage Vcom at the time T3 and may be a state in which it is increased to the voltage Vb. At the time T3, the reference voltage is increased to the voltage Vb in the boost line such that the boosting effect by the boost voltage Vboost is decreased by the voltage Vb.

In FIG. 6, in the liquid crystal display (LCD) according to the present invention, the primary boost voltage is applied at the time T4 at which the predetermined time is delayed from the is time T3 at which the application of the positive data voltage Vdat is finished, and the secondary boost voltage is applied at the time T6 at which the predetermined time is delayed from the time T4. The data line is applied with the negative data voltage according to the line inversion method in the period T3-T5 such that the voltage of the boost line is changed (decreased) by the voltage Vc that is lower than the initial boost voltage. The initial boost voltage as the reference voltage before the boost voltage is changed may be the voltage of the logic low level or the voltage of the logic high level. The voltage of the logic low level as the initial boost voltage is applied to the boost line connected to the pixel that is applied with the positive data voltage, and the voltage of the logic high level as the initial boost voltage is applied to the boost line connected to the pixel that is applied with the negative data voltage.

The primary boost voltage of the logic high level is applied at the time T4 at which the voltage that is lower than the initial boost voltage is formed in the boost line. The primary boost voltage may be a middle value of a target boost voltage. For example, when the initial boost voltage is −2V and the target boost voltage is 2V, the primary boost voltage may be 0V as the common voltage Vcom. In the period T5-T7, the data line is applied with the positive data voltage such that the voltage of the boost line is changed (increased) by the voltage Vd. The secondary boost voltage of the logic high level is applied at the time T6 at which the voltage of the boost line is increased compared with the target boost voltage by the data voltage. The secondary boost voltage is the target boost voltage. The boosting effect by the primary boost voltage is increased by the voltage Vc, and the boosting effect by the secondary boost voltage is increased by the voltage Vd. Accordingly, the voltage of the pixel may be additionally boosted by the voltages Vc and Vd, and thereby the pixel voltage that is decreased by the voltage Va may be compensated.

$$\text{target pixel voltage } Vpixel = Vdat + K \times \Delta Vboost$$

Here, $K = Cst/(Cst+Clc)$.

In the representative liquid crystal display (LCD) different from the present invention, the actual voltage of the pixel becomes $(Vdat-Va)+K\times\Delta(Vboost-Vb)$ by the coupling between the data line and the boost line such that it is lower than the target pixel voltage. The crosstalk may be generated by the difference between the target voltage of the pixel and the actual voltage of the pixel.

In the liquid crystal display (LCD) according to the present invention, the pixel voltage becomes $(Vdat-Va)+K\times(\Delta Vboost+Vc+Vd)$. Here, if the time T4 at which the primary boost voltage is applied and the time T6 at which the secondary boost voltage is applied are appropriately controlled for $K\times\Delta(Vc+Vd)-Va=0$, the actual voltage of the pixel may accord with the target voltage of the pixel. That is, the times at which the primary boost voltage and the secondary boost voltage are applied are adjusted for the voltage of the plurality of pixels that is lower than the target voltage of the pixels because of the coupling between the plurality of data lines D1-Dm and the plurality of boost lines B1-Bn to be compensated. Accordingly, the crosstalk that is generated by the coupling between the data line and the boost line may be reduced.

Figure 7:
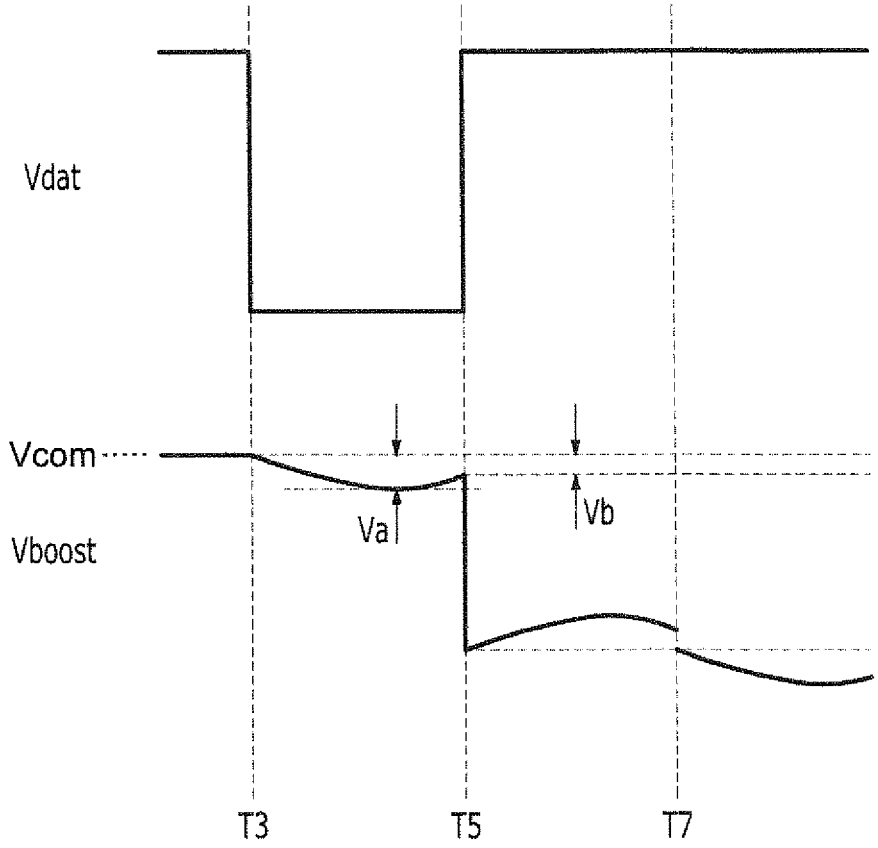
FIG. 7 is another example showing a data voltage and a boost voltage in a representative liquid crystal display (LCD) different from the present invention.
Figure 8:
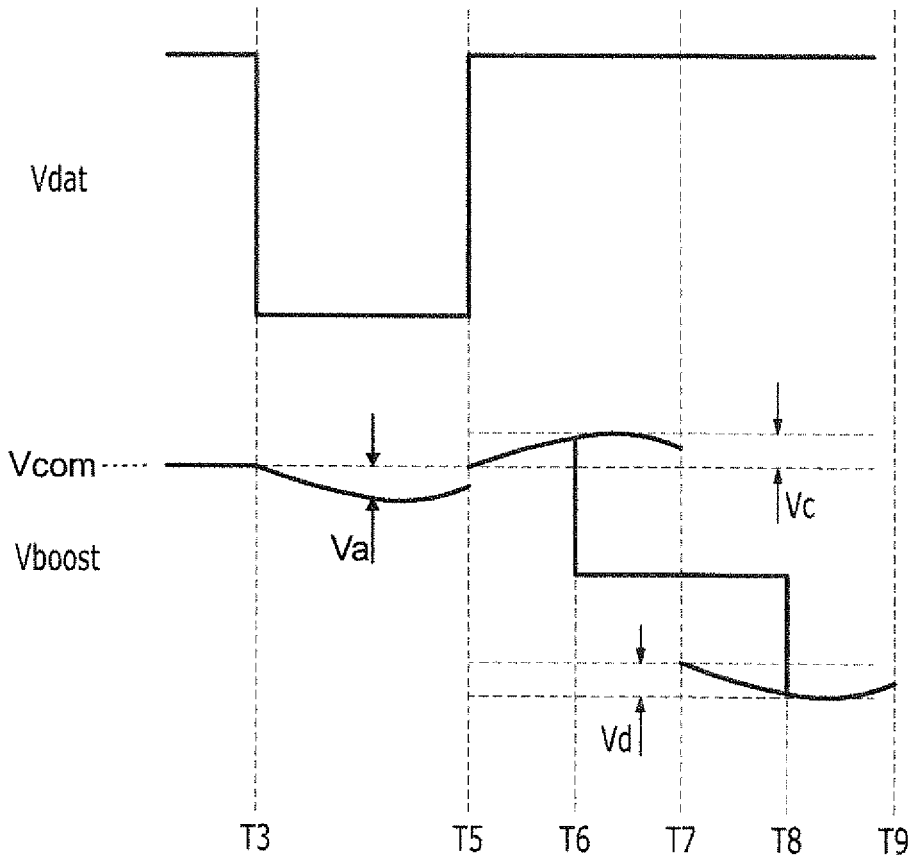
FIG. 8 is a view showing a data voltage and a boost voltage in a liquid crystal display (LCD) according to another exemplary embodiment of the present invention.

FIG. 7 is another example showing a data voltage and a boost voltage in a representative liquid crystal display (LCD) different from the present invention. FIG. 8 is a view showing a data voltage and a boost voltage in a liquid crystal display (LCD) according to another exemplary embodiment of the present invention.

Referring to FIG. 7 and FIG. 8, a negative predetermined data voltage Vdat with reference is to the common voltage Vcom is applied to one of a plurality of data lines D1-Dm in the period T3-T5.

In FIG. 7, in the representative liquid crystal display (LCD) different from the present invention, the boost voltage Vboost of the logic low level is applied at the time T5 at which the application of the negative data voltage Vdat is finished. The voltage of the boost line is changed (decreased) by the voltage Va due to the coupling between the data line and the boost line in the period T3-T5, and the actual voltage of the pixel is decreased by the voltage Va. Also, the voltage of the boost line is not restored to the common voltage Vcom at the time T5 and may be in a state in which it is increased to the voltage Vb, and the boosting effect by the boost voltage Vboost is decreased by the voltage Vb.

In FIG. 8, in the liquid crystal display (LCD) according to the present invention, the primary boost voltage is applied at the time T6 at which the predetermined time is delayed from the time T5 at which the application of the negative data voltage Vdat is finished, and the secondary boost voltage is applied at the time T8. The voltage of the boost line is changed (increased) by the voltage Vc that is higher than the common voltage Vcom in the period T5-T7, and is changed (decreased) by the voltage Vd that is lower than the target boost voltage in the period T7-T9. The boosting effect by the primary boost voltage is increased by the voltage Vc, and the boosting effect by the secondary boost voltage is increased by the voltage Vd. Accordingly, the voltage of the pixel may be additionally boosted by the voltages Vc and Vd, and thereby the pixel voltage that is decreased by the voltage Va may be compensated.

In the liquid crystal display (LCD) according to the present invention, the pixel voltage is becomes $(Vdat-Va)+K\times(\Delta V\text{-}boost+Vc+Vd)$, and if the time T6 at which the primary boost voltage is applied and the time T8 at which the secondary boost voltage is applied are appropriately controlled for $K\times\Delta(Vc+Vd)-Va=0$, the actual voltage of the pixel may accord with the target voltage of the pixel.

The drawings and the detailed description above are examples for the present invention and are provided to explain the present invention, and the scope of the present invention described in the claims is not limited thereto. Therefore, it will be appreciated to those skilled in the art that various modifications may be made and that other equivalent embodiments are available. Accordingly, the actual scope of the present invention must be determined by the spirit of the appended claims.

What is claimed is:

1. A liquid crystal display (LCD) comprising:

a liquid crystal panel including a plurality of pixels and a plurality of boost lines connected to the plurality of pixels, the boost lines having an initial boost voltage applied thereto to place a voltage on each of the boost lines;

a data driver applying a data voltage to a plurality of data lines connected to the plurality of pixels;

a scan driver applying a scan voltage to a plurality of scan lines connected to the plurality of pixels in synchronization with a scan clock signal controlling an output of the scan signal for the data voltage to be applied to the plurality of pixels; and a boost driver applying the initial boost voltage to the plurality of boost lines connected to the plurality of pixels, the boost driver then applying a primary boost voltage to the plurality of boost lines to increase or decrease the voltage on the boost lines and then applying a secondary boost voltage to the plurality of boost lines to further increase or further decrease the voltage on the boost lines, the primary boost voltage and the secondary boost voltage being generated in synchronization with a boost clock signal controlling the output of the boost voltages, wherein the boost clock signal has different synchronization from the scan clock signal controlling the output of the scan signal.

2. The liquid crystal display (LCD) of claim 1, wherein the boost driver applies the primary boost voltage at a predetermined time that is delayed from a time that the scan signal of the gate-off voltage is applied.

3. The liquid crystal display (LCD) of claim 2, wherein the boost driver applies the secondary boost voltage at a time that is delayed by the boost clock signal controlling the output of the secondary boost voltage after the primary boost voltage is applied.

4. The liquid crystal display (LCD) of claim 3, wherein the primary boost voltage has a middle value between the initial boost voltage and the secondary boost voltage.

5. The liquid crystal display (LCD) of claim 4, wherein the primary boost voltage is a common voltage.

6. The liquid crystal display (LCD) of claim 5, wherein the data driver inverts the polarity of the data voltage for a line of the plurality of scan lines and applies the data voltage.

7. The liquid crystal display (LCD) of claim 6, wherein the initial boost voltage is a voltage of a logic low level, and the secondary boost voltage is a voltage of a logic high level.

8. The liquid crystal display (LCD) of claim 6, wherein the initial boost voltage is a voltage of a logic high level, and the secondary boost voltage is a voltage of a logic low level.

9. The liquid crystal display (LCD) of claim 6, wherein the time that the primary boost voltage and secondary boost voltage are applied is adjusted to compensate a voltage of the plurality of pixels that is lower than a target voltage of the pixels by a coupling between the plurality of data lines and the plurality of boost lines.

10. A method for driving a liquid crystal display (LCD) comprising:

applying a scan signal of a gate-on voltage to a scan line connected to a pixel;

applying a data voltage to a data line connected to the pixel during a time the scan signal of the gate-on voltage is applied;

applying an initial boost voltage to a boost line connected to the pixel to place a predetermined voltage on the boost line;

applying a primary boost voltage to the boost line to increase or decrease the voltage on the boost line at a time that a predetermined time is delayed from a time that the application of the data voltage to the pixel is finished; and applying a secondary boost voltage to the boost line to further increase or further decrease the voltage on the boost line at a time that a predetermined time is delayed from a time that the primary boost voltage is applied.

11. The method of claim 10, wherein the primary boost voltage and the secondary boost voltage are applied to the boost line in synchronization with a boost clock signal controlling the output of the boost voltage having the different synchronization from a scan clock signal controlling the output of the scan signal.

12. The method of claim 11, wherein the primary boost voltage is a middle value between an initial boost voltage and the secondary boost voltage.

13. The method of claim 12, wherein the primary boost voltage is a common voltage.

14. The method of claim 13, wherein the polarity of the data voltage is inverted for a line of a plurality of scan lines.

15. The method of claim 12, wherein the initial boost voltage is a voltage of a logic low level, and the secondary boost voltage is a voltage of a logic high level.

16. The method of claim 12, wherein the initial boost voltage is a voltage of a logic high level, and the secondary boost voltage is a voltage of a logic low level.

17. The method of claim 12, wherein the time that the primary boost voltage and secondary boost voltage are applied is adjusted to compensate a voltage of the pixel that is lower than a target voltage of the pixel by a coupling between the data lines and the boost lines.

* * * * *